United States Patent [19]

Mattis

[11] 3,958,099

[45] May 18, 1976

[54] ELECTRICAL RESISTANCE UNIT FOR IGNITOR PLUGS

[75] Inventor: Donald J. Mattis, Norwalk, Conn.

[73] Assignee: Sun Chemical Corporation, New York, N.Y.

[22] Filed: Sept. 9, 1975

[21] Appl. No.: 611,681

[52] U.S. Cl. ..... 219/270; 219/536; 219/552; 317/98

[51] Int. Cl.[2] ..... F23Q 7/22

[58] Field of Search ..... 219/260, 265, 267, 270, 219/536, 541, 552; 317/98

[56] References Cited

UNITED STATES PATENTS

| | | | |
|---|---|---|---|
| 2,062,701 | 12/1936 | Cohen | 219/270 |
| 3,573,428 | 4/1971 | Deming | 219/265 |
| 3,892,944 | 7/1975 | Horwitt et al | 219/270 |
| 3,909,587 | 9/1975 | Mattis | 219/270 |

*Primary Examiner*—Volodymyr Y. Mayewsky
*Attorney, Agent, or Firm*—Cynthia Berlow

[57] ABSTRACT

An electrical igniting element for use with ignitor devices such as are commonly utilized in electrical cigar lighters, engine ignitor plugs, and the like comprises a heating element, such as a wound spiral of resistance ribbon, carried on an annular metal holder or cup and spanning the mouth or opening thereof. The inner end of the spiral ribbon is secured to a central metal stud as by crimping and/or welding it in a slotted head thereof. The invention provides improved means for securing the outer coil convolution to the rim of the holder or cup by curling inward the rim edge into a tight curl which is laid over on the end portions of the coil convolution whereby a relatively large area of the coil end is tightly and securely pinched under continual pressure, thereby establishing a low-resistance effective mechanical and electrical connection between the cup and the coil throughout the useful life of the latter.

5 Claims, 4 Drawing Figures

FIG. 3
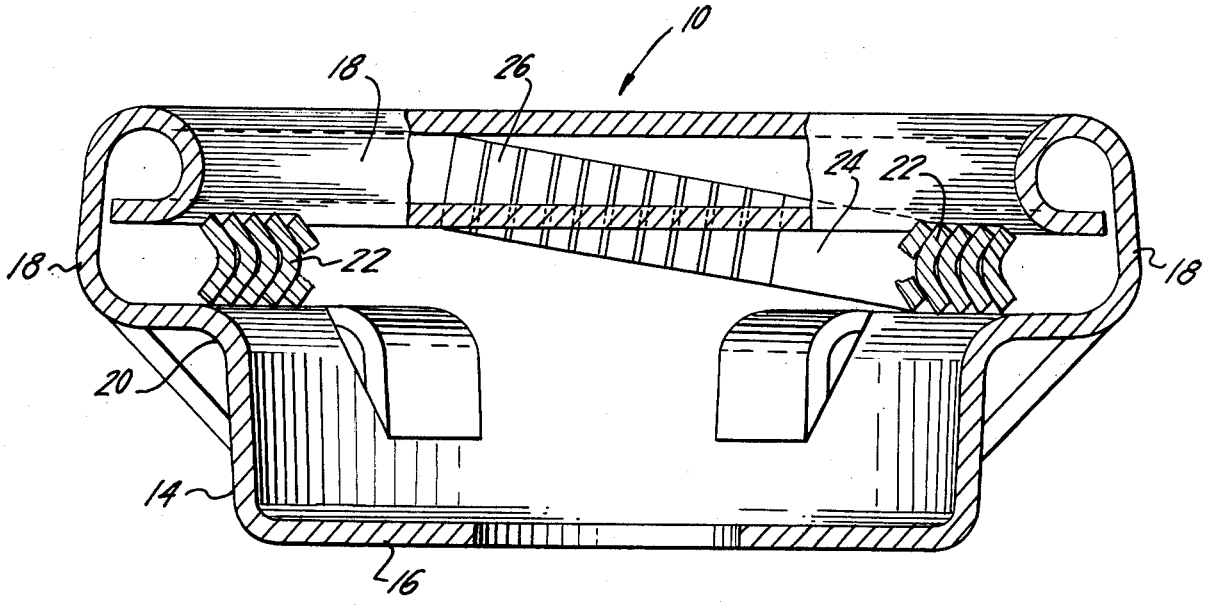
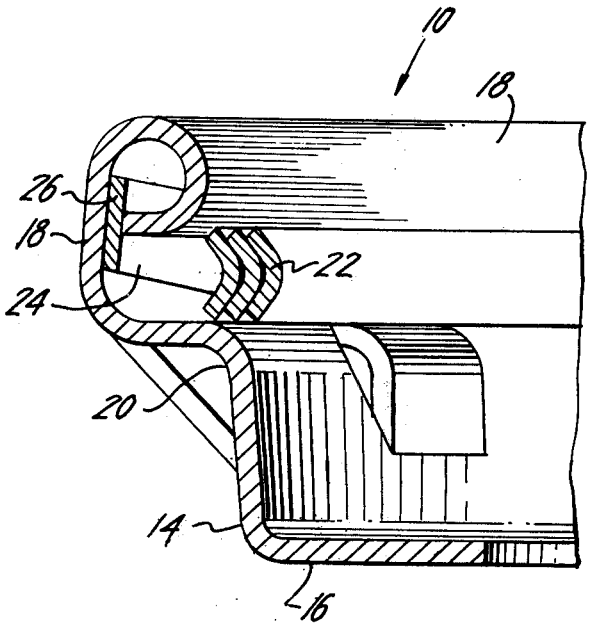
FIG. 4

ELECTRICAL RESISTANCE UNIT FOR IGNITOR PLUGS

BACKGROUND

This invention relates to electrical ignitor plugs such as are commonly used in electric cigar lighters, combustion engines, and the like; more particularly it relates to the securing of the outer end of a spiral heating coil to the rim of a metal holder or container cup therefor.

In the past it has been a common procedure to outwardly offset the outer end of a spiral heating coil of a cigar lighter or other ignitor and then spot weld the end to the inner wall of a metal container cup. While such an arrangement has been considered satisfactory and has been practised for many years, it has inherent disadvantages and drawbacks. In order for the completed unit to perform satisfactorily throughout the useful life of the coil, the weld at the outer end must be sufficiently secure not to loosen under the action of heat and physical stresses; however, the welding operation should not have progressed to the extent where the resistance ribbon becomes weakened and loses its physical and electrical characteristics, causing burnout or breakage to occur at a later time.

In order to obtain a product which is satisfactory in meeting the above conditions, it has been necessary to inspect carefully the welds that are made. For the ultimate in the quality of the product, a 100-per cent inspection is generally necessary. This inspection requires skilled personnel and represents an appreciable expense.

Moreover, during continuous volume production of igniting units of this type, frequent replacement of the welding electrode is necessary, involving down-time and the services of a tool setter. Replacement of electrodes as often as every 15 minutes is commonplace. The down-time, tool setter's labor, and cost of the electrodes further add to the expense of the igniting units.

Additionally, igniting units made in this manner present a raw and somewhat unfinished appearance when viewed head-on, the product appearing to be the result of temporary tooling rather than finished production tooling.

Other methods of securing the end of the heating element to the cup include staking and shearing, as in U.S. Pat. Nos. 3,012,127 and 3,573,428. These methods present the problem of orientation as well as resulting, as does the welding or brazing method, in small contact areas between the resistance ribbon and the cup.

SUMMARY

The above disadvantages and drawbacks of prior electrical ignitor units are obviated by the present invention which has for its main object the provision of an improved heating element and metal holder or cup assemblage wherein a permanent electrical connection is established from the cup to the heating element without requiring welding or similar techniques, but instead utilizing a continuous inturned rim portion of the cup. A related object of the invention is the provision of an improved ignitor unit for plugs as above set forth, which is especially economical to produce, has a finished appearance, and results in a permanent and low-resistance connection between the cup and the heating element.

The above objects are accomplished in one embodiment of the invention by the provision of a metal cup having a somewhat deeper side wall than was heretofor utilized and by curling inward quite tightly the rim of the side wall so as to sandwich and securely crimp end portions of the outer coil convolution of the heating element. A circumferential coil portion extending through an arc of as much as 45° or more is secured by such inward curl, which effectively mechanically and electrically joins the coil to the cup. The juncture is not only mechanically permanent and electrically efficient, exhibiting low electrical resistance, but additionally provides an attractive rounded or beaded edge on the cup which presents a neat and finished appearance. A lesser degree of inspection is required to maintain acceptable quality, and replacement of welding electrodes is no longer needed. Also, the previously required frequent down-time and service of a tool setter are no longer necessary, resulting in a significant economy in the manufacture of the product. Moreover, fully automatic equipment can now be utilized to effect the improved mechanical and electrical juncture of the coil and cup.

Other features and advantages will hereinafter appear.

In the accompanying drawings illustrating a preferred embodiment of the invention:

FIG. 3 is a partly fragmentary cross sectional view of the heating unit of FIG. 1.

FIG. 4 is a fragmentary cross sectional view, greatly enlarged, through the rim of the supporting metal cup of the unit and the crimped portion of the heating coil.

Figure 1:
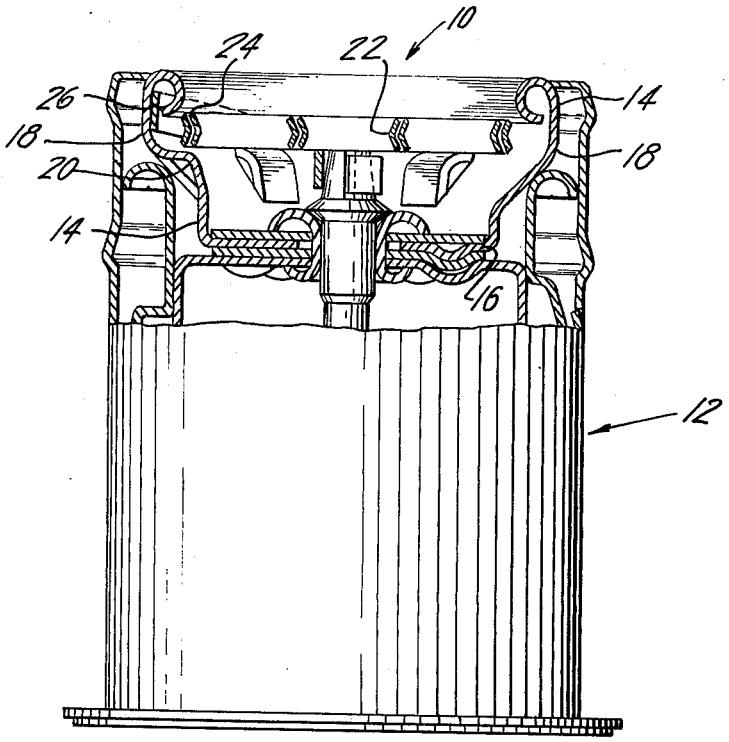
FIG. 1 is a view partly in side elevation and partly in cross section of an improved electrical heating unit for ignitor plugs, as provided by the invention.

As shown in FIG. 1, the improved heating unit or element of the invention, designated generally by the numeral 10, is mounted on an ignitor plug body 12 which can be that of an electric cigar lighter.

The heating unit 10 comprises a shallow metal cup 14 having a flat bottom wall 16 which is secured to the plug body 12 in a usual manner.

The side walls 18 of the cup 14 are lanced inward at a number of places around the circumference to provide shelf portions 20 which constitute a support for the outermost or large-diameter convolutions of a spiral heating coil 22. Heating coils such as the coil 11 are conventional and well known in the art.

The outermost convolution 24 of the heating coil 22 terminates at an end 26 which is outwardly offset from the remainder of the coil, also in the usual manner.

The heating element is generally, but not necessarily, a coil of a ribbon-like strip of suitable electrical resistance alloy. In the preferred embodiment the ribbon has a contoured V-shaped cross section, as shown in U.S. Pat. No. 3,235,707 wound to form a plurality of successive interlocking convolutions; the heating element has the form of a substantially disc-like member and, because of the interlocking of the successive convolutions, resists axial displacement.

Figure 2:
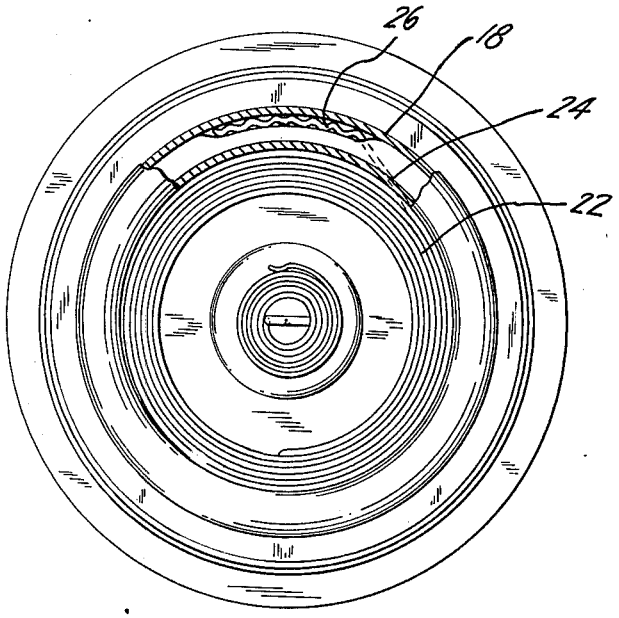
FIG. 2 is a partially fragmentary front and elevational view of the heating unit of FIG. 1.

As seen in FIG. 2, it is within the scope of this invention to have the end of the ribbon 26 rippled, as in U.S. Pat. No. 2,936,358, resulting in resiliency which gives a tighter and more uniform bond between the ribbon and the cup.

In accordance with the present invention the cup 14 is initially formed with a deeper side wall than usual, and the leading edge or rim of the cup is curled inward to form essentially a 360° tight bead which overlies and sandwiches the offset end 26 of the heating coil 22. The curling-in of the cup wall can be effected by a punch-type tool which initiates and then completes the curl in a single operation. As the curl develops and the curling edge sweeps inward and backward it automatically entraps the offset outer end 26 of the heating coil 22 and mechanically and electrically secures such end, as clearly illustrated in FIG. 4 which represents an actual microphotograph of a cut-through portion of a heating unit. While the wall 18 of the cup is of relatively thin metal, it has great strength when formed into a tight small-diameter curl whereby it securely clamps and retains the outer coil convolution and effects a permanent, low-resistance connection thereto which is not adversely affected by subsequent heating or the stresses of usage. By virtue of the clamping occurring over an arc as great as 45°, there is no possibility of loosening of the secured coil end.

FIG. 3 shows the coil rotated 90° to show the end 26 of the outermost convolution 24 of the coil 22 rising from the plane of the coil to the area where it is held by the curled-in rim of cup wall 18.

The joining of the heating coil 22 to the cup 14 in the manner described above can be quickly accomplished by an automatic assembly tool. The process by which the inward curling of the cup rim entraps the offset coil end assures a positive attachment each time, requiring no orientation and decreasing the degree of inspection required to maintain acceptable and consistent quality.

The above-described arrangement and the tooling developed therefor have the advantages of not requiring the offset end of the heating coil to be held rigidly against the inner face of the cup, permitting large variances in the position in the plane parallel to the face of the coil, and having a relatively large area of the resistance ribbon in contact with the cup.

There is not required any welding procedure with the likelihood of weakening of the coil end, replacement of welding electrodes, or down-time with the consequent expenses and costs attendant thereto. The inwardly curled edge of the cup 14 provides a neat and attractive finished appearance with no sharp, cut edges being visible. Moreover, the time of assembly is much less, all with the result that an improved product is had at an appreciably lower cost.

The present improved heating unit has utility for all types of ignitor plugs, such as those used in cigar lighters, combustion engines, etc. The unit is especially rugged and characterized by an extended service life.

Variations and modifications are possible without departing from the spirit of the invention.

What is claimed is:

1. An electrical igniting unit for ignitor plugs and the like comprising in combination:

a. an annular metal holder having relatively thin side walls, b. a heating element disposed in said holder and having a short outer end juxtaposed to the side walls thereof, c. the entire leading edge of the side walls of the holder being inwardly crimped over and firmly sandwiching an end portion of the heating element, whereby the end of the heating element is both permanently mechanically secured to the side wall and electrically connected thereto, d. the holder comprising a shallow metal cup adapted to have its bottom wall secured to an ignitor plug body, and e. an electrical connection means to the other end of the heating element, supporting the same.

2. The igniting unit of claim 1 where the crimp of the holder wall is substantially circular in cross section and extends through an arc of substantially 360°.

3. The igniting unit of claim 1 wherein the crimped edge of the holder wall secures an end portion of the heating element through an arc of substantially 45°.

4. The igniting unit of claim 1 wherein the heating element is a coil of resistance ribbon.

5. The igniting unit of claim 2 wherein the entire leading edge of the side walls of the holder is curled over inwardly and bites into the flat inside of the end portion of the ribbon.

* * * * *